US006447354B1

(12) United States Patent
Hofmann et al.

(10) Patent No.: US 6,447,354 B1
(45) **Date of Patent: *Sep. 10, 2002**

(54) FIBER SPACERS IN LARGE AREA VACUUM DISPLAYS AND METHOD FOR MANUFACTURE

(75) Inventors: James J. Hofmann; Jason B. Elledge, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/940,003

(22) Filed: Aug. 27, 2001

Related U.S. Application Data

(63) Continuation of application No. 09/652,290, filed on Aug. 31, 2000, now Pat. No. 6,280,274, which is a continuation of application No. 09/414,862, filed on Oct. 12, 1999, now Pat. No. 6,155,900.

(51) Int. Cl.[7] ..... H01J 9/24
(52) U.S. Cl. ..... 445/24
(58) Field of Search ..... 445/24; 313/495

(56) References Cited

U.S. PATENT DOCUMENTS

| | | | |
|---|---|---|---|
| 3,424,909 | A | 1/1969 | Rougeot |
| 3,812,559 | A | 5/1974 | Spindt et al. |
| 3,875,442 | A | 4/1975 | Wasa et al. |
| 3,979,621 | A | 9/1976 | Yates |
| 3,990,874 | A | 11/1976 | Schulman |
| 4,091,305 | A | 5/1978 | Poley et al. |
| 4,183,125 | A | 1/1980 | Meyer et al. |
| 4,292,092 | A | 9/1981 | Hanak |
| 4,451,759 | A | 5/1984 | Heynisch |
| 4,705,205 | A | 11/1987 | Allen et al. |
| 4,749,840 | A | 6/1988 | Piwczyk |
| 4,874,461 | A | 10/1989 | Sato et al. |
| 4,892,592 | A | 1/1990 | Dickson et al. |
| 4,923,421 | A | 5/1990 | Brodie et al. |
| 4,940,916 | A | 7/1990 | Borel et al. |
| 4,973,378 | A | 11/1990 | Lee et al. |
| 5,070,282 | A | 12/1991 | Epsztein |
| 5,136,764 | A | 8/1992 | Vasquez |
| 5,151,061 | A | 9/1992 | Sandhu |
| 5,205,770 | A | 4/1993 | Lowrey et al. |
| 5,209,688 | A | 5/1993 | Nishigaki et al. |
| 5,229,691 | A | 7/1993 | Shichao et al. |
| 5,232,549 | A | 8/1993 | Cathey et al. |
| 5,324,602 | A | 6/1994 | Inada et al. |
| 5,329,207 | A | 7/1994 | Cathey et al. |
| 5,342,477 | A | 8/1994 | Cathey |
| 5,342,737 | A | 8/1994 | Georger, Jr. et al. |

(List continued on next page.)

FOREIGN PATENT DOCUMENTS

| | | | |
|---|---|---|---|
| EP | 690472 | A1 | 3/1996 |
| JP | 2-165540 | A | 6/1990 |

OTHER PUBLICATIONS

Hashiguchi, Mimur and Hiroyuki, "Fabrication and Emission Characteristics of Polycrystalline Silicon Field Emitters," Jpn. J. Appl. Phys. vol. 34 (1995).

Itoh, S., Niiyama, T., and Yokoyama, M., "Influence of Various Gases on the Emission of Field Emitter Arrays," Futaba Corporation (2 pages).

Levy, F., and Meyer, R., "Phosphors for Full–Color Microtips Fluorescent Displays," Conference Record of the 1991 International Display Research Conference, pp. 20–23.

*Primary Examiner*—Kenneth J. Ramsey
(74) *Attorney, Agent, or Firm*—TraskBritt

(57) ABSTRACT

A process for fabricating high-aspect ratio support structures comprising: creating a rectangular fiber bundle by stacking selectively etchable glass strands having rectangular cross-sections; slicing the fiber bundle into rectangular tiles; adhering the tiles to an electrode plate of an evacuated display; and selectively removing glass strands, thereby creating support structures.

28 Claims, 7 Drawing Sheets

U.S. PATENT DOCUMENTS 5,347,292 A 9/1994 Ge et al.
5,371,433 A 12/1994 Home et al.
5,374,868 A 12/1994 Tjaden et al.
5,391,259 A 2/1995 Cathey et al.
5,413,513 A 5/1995 Home et al.
5,445,550 A 8/1995 Xie et al.
5,448,131 A 9/1995 Taylor et al.
5,449,970 A 9/1995 Kumar et al.
5,486,126 A 1/1996 Cathey et al.
5,561,343 A 10/1996 Lowe
5,621,272 A 4/1997 Levine et al.
5,634,585 A 6/1997 Stansbury
5,648,698 A 7/1997 Makishima et al.
5,708,325 A 1/1998 Anderson et al.
5,717,287 A 2/1998 Amrine et al.
5,795,206 A 8/1998 Cathey et al.
5,811,927 A 9/1998 Anderson et al.
5,989,090 A 11/1999 Perrin et al.
6,155,900 A * 12/2000 Hofmann et al. ..... 445/24
6,280,274 B1 * 8/2001 Hofmann et al. ..... 445/24

* cited by examiner

FIBER SPACERS IN LARGE AREA VACUUM DISPLAYS AND METHOD FOR MANUFACTURE

CROSS-REFERENCE TO RELATED APPLICATIONS

This application is a continuation of application Ser. No. 09/652,290, filed Aug. 31, 2000, which issued on Aug. 28, 2001 as U.S. Pat. No. 6,280,274 B1; which is a continuation of application Ser. No. 09/414,862, filed Oct. 12, 1999, now U.S. Pat. No. 6,155,900, issued Dec. 5, 2000. +gi

STATEMENT REGARDING FEDERALLY SPONSORED RESEARCH OR DEVELOPMENT

This invention was made with Government support under Contract No. DABT63-93-C-0025 awarded by Advanced Research Projects Agency (ARPA). The Government has certain rights in this invention.

BACKGROUND OF THE INVENTION

1. Field of the Invention

This invention relates to flat panel display devices and, more particularly, to processes for creating fiber spacer structures which provide support against the atmospheric pressure on the flat panel display without impairing the resolution of the image.

2. State of the Art

In flat panel displays of the field emission type, an evacuated cavity is maintained between the cathode electron-emitting surface and its corresponding anode display face. Since there is a relatively high voltage differential between the cathode electron-emitting surface and the display screen, it is important to prevent catastrophic electrical breakdown between them. At the same time, the narrow spacing between the plates is necessary for structural thinness and to obtain high image resolution. Spacer structures incorporated between the display face and the baseplate perform these functions.

In order to be effective, spacer structures must possess certain characteristics. They must have sufficient nonconductivity to prevent catastrophic electrical breakdown between the cathode array and the anode. This is necessary because of both the relatively close inter-electrode spacing (which may be on the order of 200 $\mu$m) and relatively high inter-electrode voltage differential (which may be on the order of 300 or more volts).

Further, the supports must be strong enough to prevent the flat panel display from collapsing under atmospheric pressure. Stability under electron bombardment is also important, since electrons will be generated at each of the pixels. The spacers must also withstand "bake-out" temperatures of around 400° C. used in forming the high vacuum between the faceplate and baseplate of the display.

For optimum screen resolution, the spacer structures must be almost perfectly aligned to array topography. They must be of sufficiently small cross-sectional area so as to be invisible during display operation. Hence, cylindrical spacers must have diameters no greater than about 50 microns. A single cylindrical lead oxide silicate glass column, having a diameter of 25 microns and a height of 200 microns, will have a buckle load of about $2.67\times10^{-2}$ newtons. Buckle loads, of course, will decrease as height is increased with no corresponding increase in diameter.

It is also of note that a cylindrical spacer having a diameter d will have a buckle load that is only about 18% greater than that of a spacer of square cross-section and a diagonal d, although the cylindrical spacer has a cross-sectional area about 57% greater than the spacer of square cross-section.

Known methods for spacer fabrication using screen-printing, stencil printing, or glass balls do not provide a spacer having a sufficiently high aspect ratio. The spacers formed by these methods either cannot support the high voltages or interfere with the display image. Other methods which employ the etching of deposited materials suffer from slow throughput (i.e., time length of fabrication), slow etch rates, and etch mask degradation. The use of lithographically defined photoactive organic compound results in the formation of spacers which are incompatible with the high vacuum conditions and elevated temperatures characteristic in the manufacture of field emission displays (FED).

Accordingly, there is a need for a high aspect ratio spacer structure for use in a FED and an efficient method of manufacturing a FED with such a spacer.

BRIEF SUMMARY OF THE INVENTION

A process for fabricating high-aspect ratio support structures is provided. The process comprises creating a rectangular fiber bundle of glass strands, wherein contiguous groups of glass strands form a pattern. The pattern can be of a variety of shapes, including a cross T, I-beam, rail, or bracket. The fiber bundle is sliced into "tiles" and adhered to an electrode plate of an evacuated display.

The fiber bundle is comprised of groups of selectively etchable glass strands, which may or may not be coated with a resistive material. The glass strands are preferably square in cross-section and are, therefore, stackable. The etchable and nonetchable strands are stacked in a desired pattern in the bundle; the bundle is drawn to thereby increase its length and decrease its diameter, while maintaining its shape and pattern. Several bundles are then stacked and drawn into a fiber boule. The fiber boule is sliced into rectangular tiles. Adhesive is deposited on the electrode plate of the vacuum display to hold the tiles in the desired locations, and the tiles disposed about the display plate. Some of the glass fibers are then selectively removed, thereby creating support structures.

In an alternative embodiment of the present invention, a process for forming spacers useful in large area displays is disclosed. The process comprises forming rectangular bundles comprising fiber strands held together with a binder, slicing the bundles into rectangular slices, adhering the slices onto an electrode plate of the display, and removing the binder. The ends of the glass fibers may be polished, and the binder near the ends of the glass fibers etched back. The binder is then removed, thereby creating spacers.

One advantage of this method of stacking fibers in a pattern and forming boules therefrom is that collimated spacers are made in an accurate, repeatable pattern, not easily attainable when other shapes, such as round fibers, are utilized. This reduces the cost of manufacturing the panel, as well as the weight of the panel. The use of such spacers enables the sintering of thin panel glass substrates, while holding off the forces due to atmospheric pressure. This technique will also result in high aspect ratio spacers, so higher resolution can be attained without having the output image adversely affected by the presence of spacers. This technique also increases the chances that the fiber strand is orderly and regularly distributed in the glass boule. The evenly collimated distribution is maintained throughout the spacer forming process, thereby improving the yield in the percentage of fibers adhering onto the adhesive dots.

BRIEF DESCRIPTION OF THE SEVERAL VIEWS OF THE DRAWINGS

The present invention will be better understood from reading the following description of nonlimitative embodiments, with reference to the attached drawings, wherein:

FIG. 6A is a spacer support structure comprising columns disposed about the electrode plate, according to the process of the present invention;

FIG. 6B is a spacer support structure comprising a rail support disposed about the electrode plate, according to an alternative embodiment of the process of the present invention; and FIG. 6C is a spacer support structure comprising a cross-rail support structure disposed about the electrode plate, according to another alternative embodiment of the process of the present invention.

DETAILED DESCRIPTION OF THE INVENTION

Figure 1:
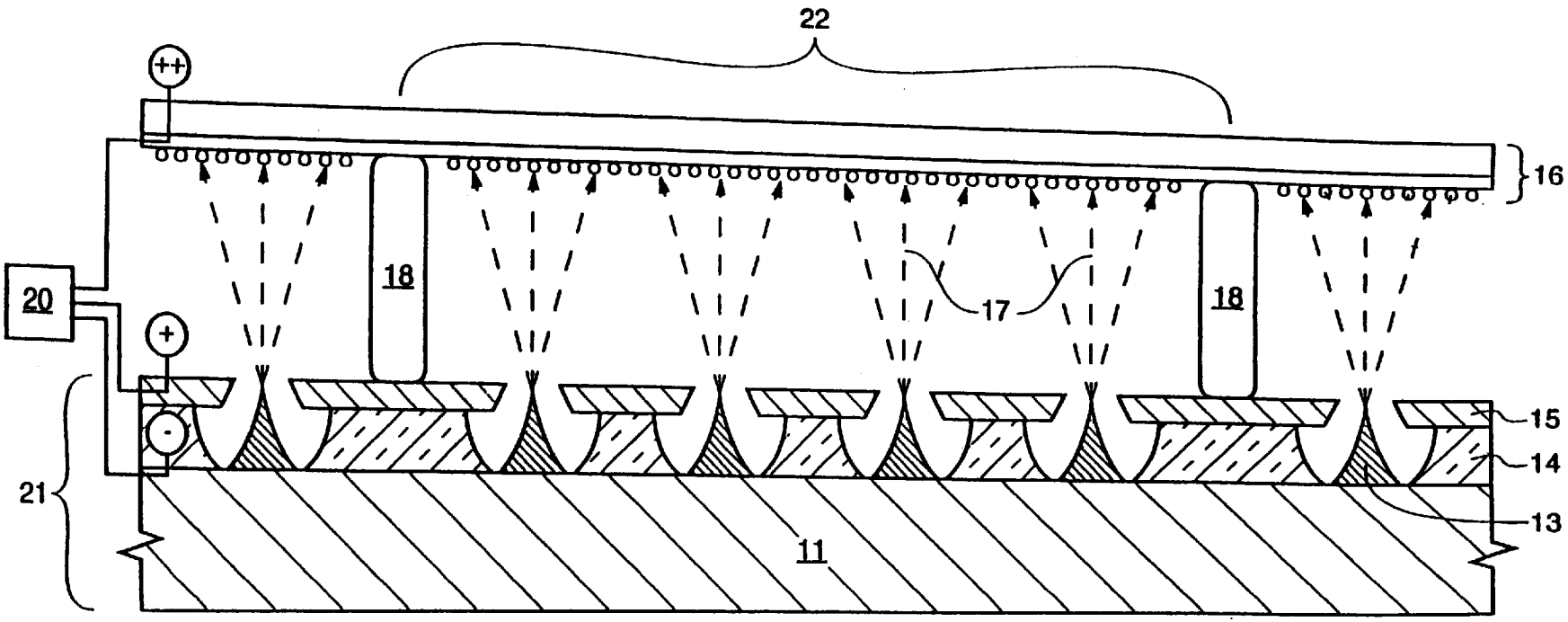
FIG. 1 is a schematic cross-section of a representative pixel of a field emission display comprising a faceplate with a phosphor screen, vacuum sealed to a baseplate which is supported by the spacers formed according to the process of the present invention.

Referring to FIG. 1, a representative field emission display employing a display segment 22 is depicted. Each display segment 22 is capable of displaying a pixel of information. A black matrix 25 (FIG. 4), or grille, surrounds the segments for improving the display contrast. Gate 15 serves as a grid structure for applying an electrical field potential to its respective cathode 13. When a voltage differential, through source 20, is applied between the cathode 13 and the gate 15, a stream of electrons 17 is emitted toward a phosphor coated screen or faceplate 16. A dielectric insulating layer 14 is deposited on the conductive cathode 13.

Disposed between faceplate 16 (also referred to herein as display face 16) and baseplate 21 are spacer support structures 18, which function to support the atmospheric pressure that exists between them as a result of the vacuum.

The process of the present invention provides a method for fabricating high aspect ratio support structures to function as spacer support structures 18 through the use of stackable glass fiber strands, which have a rectangular or substantially square cross-section.

Various aspects of using fibers for spacer structures are described in U.S. Pat. No. 5,486,126, entitled "Spacers for Large Area Displays", and U.S. Pat. No. 5,795,206, entitled "Fiber Spacers in Large Area Vacuum Displays and Method for Manufacture of Same", which are commonly owned with the present invention. These patents are hereby incorporated herein by reference as if set forth in their entirety.

The preferred manufacturing process, according to the present invention, starts with fibers or strands of a nonetchable glass, such as, but not limited to, potash rubidium lead. The nonetchable glass preferably does not etch in hydrochloric acid and has significant etch resistance to aqueous hydrofluoric acid.

The etchable spacer support structures 18 are comprised of glass which has a high lead content, preferably greater than 40%. PbO added to the glass in sufficient amounts will make it soluble in HCl or other acids. The viscosity-temperature curve can be adjusted by varying the other components of the glass, such as, $Na_2O$, $CaO_2$, $Al_2O_3$, and other materials. Since the completed and assembled display is later "baked out," the coefficient of thermal expansion of the glass strands should be close to that of a substrate material 11 which is used for the display face 16 and/or baseplate 21.

The fiber strands, used in the present invention, may employ a high-resistance coating which allows a very slight bleed off of stray electrons to occur over time. This will prevent a destructive arc. Highly resistive silicon is one example of a thin coating that is useful on the fiber strands. Such a coating is applied by techniques commonly known in the art, such as chemical vapor deposition (CVD) of an organic-metal material or sputtering or evaporating a thin layer of carbon onto the silicon.

The starting nonetchable glass strand is preferably square or rectangular in cross-section. Commercially available fibers have widths from about 0.18" to 0.25", which are much too large for use as a spacer support. This width is substantially reduced through the process of the present invention, so that the width of the final glass strand is in the range of 0.001" to 0.002".

Figure 2A:
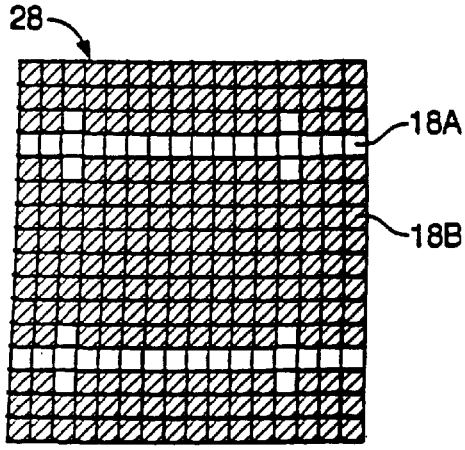
FIG. 2A is a schematic cross-section of a fiber bundle fabricated according to the process of the present invention.

As depicted in FIG. 2A, the nonetchable glass strands or fibers 18A are assembled in a pattern with etchable glass strands or fibers 18B to thereby form a mixed glass assembly 28 of a generally contiguous group of glass strands or fibers 18A, 18B. Small gaps will occur if glass strands or fibers 18A are dislodged from the mixed glass assembly 28 as a result of the manufacturing process. Since the glass strands or fibers 18A, 18B are rectangular in shape, they are relatively easy to stack in patterns. The mixed glass assembly 28 will also be rectangular or preferably, square in cross-section. The shape of the final spacer structure will be comprised of a pattern formed by the cross-sections of a plurality of the contiguous, rectangular, nonetchable glass strands or fibers 18A.

The mixed glass assembly 28 is thermally drawn down to an intermediate size. The result of this drawing step is a single-fiber unit cell or bundle 28' having a diameter of approximately 0.125". The drawing step is preferably performed in a drawing tower. The single-fiber unit cell 28', formed from the mixed glass assembly 28, has a reduced cross-section and increased length.

Figure 2B:
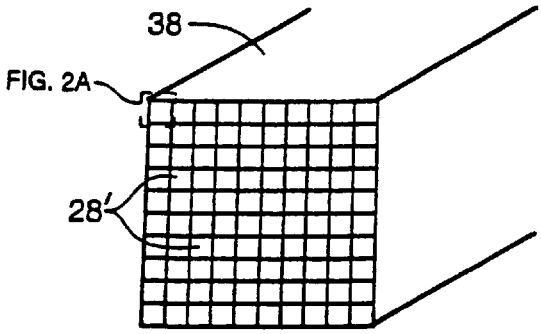
FIG. 2B is a schematic cross-section of a group of fiber bundles of FIG. 2A arranged in a boule, which is drawn to an intermediate size, according to the process of the present invention.

Several steps of glass technology are applied to transform the single-fiber unit cells 28' into a glass boule 38, as will be described herein. Such a boule 38 is comprised of up to 2000 glass fibers. FIG. 2B depicts the square or rectangular arrangement of stacked single-fiber unit cells 28'. The single-fiber unit cells 28' are stacked together in an oven (at a temperature above 100° C. but below the glass softening temperature) so that the shape is maintained.

Figure 2C:
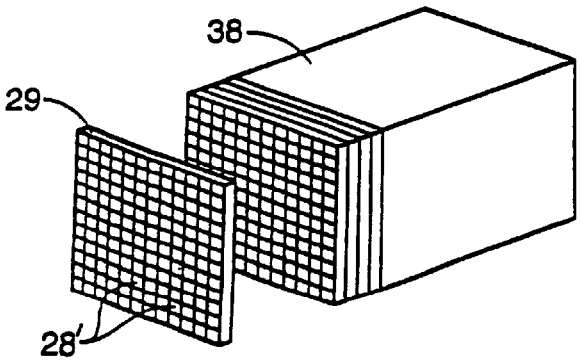
FIG. 2C is a schematic cross-section of the boule of fiber bundles of FIG. 2B, which has been drawn to a smaller size and sliced, according to the process of the present invention.
Figure 3:
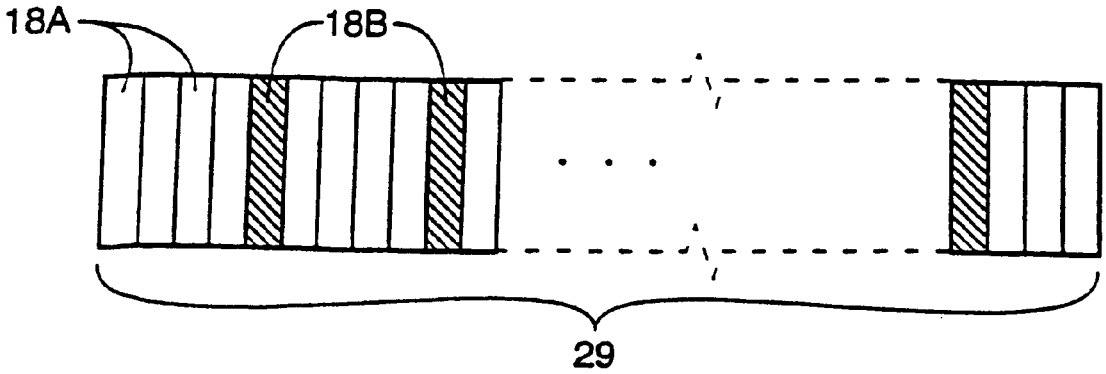
FIG. 3 is a schematic side-view of a slice of the boule of FIG. 2C, fabricated according to the process of the present invention.

As depicted in FIG. 2C, the boule 38 or stack of single-fiber unit cells is redrawn down to the final desired dimension. Each group of contiguous nonetchable glass strands or fibers 18A is surrounded by a pattern that is selectively etchable with respect to the contiguous, nonetchable fibers 18A. The fibers 18A are regularly distributed in a collimated, i.e., parallel and evenly spaced, manner within the single-fiber unit cells 28'. The outer shape of the single-fiber unit cells 28' are substantially rectangular, and the cross-sections are rectangular or square.

After drawing, there is an adherence between the glass strands of the single-fiber unit cells 28'. This may be sufficient to hold the strands in some cases. However, in other cases, the stability of the boule 38 is further enhanced by placing the drawn boule of fibers in a mold and fusing the strands under pressure, whereby a sintered, solid boule 38 is created. The boule 38 is made in a press exerting mechanical pressure on the outside of the stacked single-fiber unit cells. Appropriate sintering temperature is applied, as well as vacuum of about $10^{-3}$ Torr for removing gas from the interstices between the fibers. Alternatively, a vacuum is not applied during sintering. Acceptable sintering parameters include 300–500° C.±20° C. for several hours (between about 4–12 hours) with adequate time for annealing and cool down (about 6–12 hours for annealing and cool down). The time varies depending on thickness and pressure.

Alternatively, the glass fibers can be coated with a binder material to assist in maintaining them in the desired pattern. A temporary binder may be applied to individual fibers 18A, 18B prior to bundling, or to several fibers 18A, 18B at a time in a mixed glass assembly 28 or in close proximity, to provide spacing between fibers 18A, 18B.

However, in the preferred embodiment, no binder material is employed. Since the fibers 18A, 18B have a rectangular or substantially square cross-section, they are readily stacked in a pattern and formed into single-fiber unit cells or bundles 28' and/or boules 38.

FIGS. 2B and 2C depict the boule 38 which is sliced, on average, at about 0.015Δ to 0.020" with a wafer saw. The thickness of the slice will determine whether the cross-section of the rail is rectangular or square. Depending on how well the previous steps were carried out, there may be some unevenness in height among the strands. Hence, planarizing may be done at this point. Chemical-mechanical planarization can be used to even out the fibers. This step also polishes the fiber ends to be flat and parallel.

Figure 4:
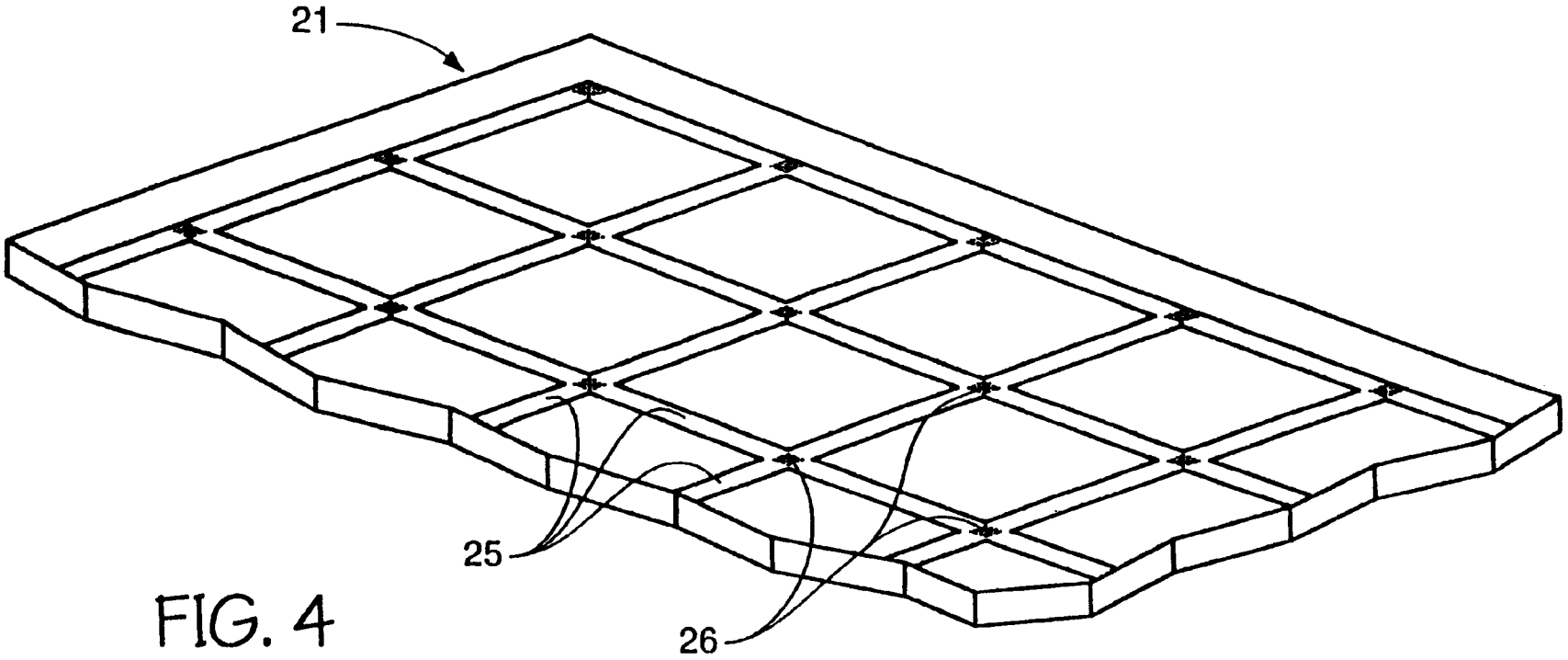
FIG. 4 is a schematic cross-section of the electrode plate of a flat panel display without the slices of FIG. 3 disposed thereon.

Once the slices or tiles 29 of fibers have been created, they are attached to one of the electrode plates (i.e., face plate/base plate) 16, 21, of the evacuated display. Referring now to FIG. 4, dots of adhesive 26 are provided at the sites where the spacer support structures 18 are to be located. Some examples of adhesives include, but are not limited to, potassium silicates and sodium silicates, which are alkaline solutions that bond glass when dried. Alternatively, epoxies can be used, as well as any other adhesion material known in the art.

One acceptable location for adhesive dots 26 is in the black matrix region 25. The black matrix region 25 is the region where there is no cathode 13 or phosphor dot. In these black matrix regions 25, the spacer support structures 18 do not distort the display image.

Figure 5:
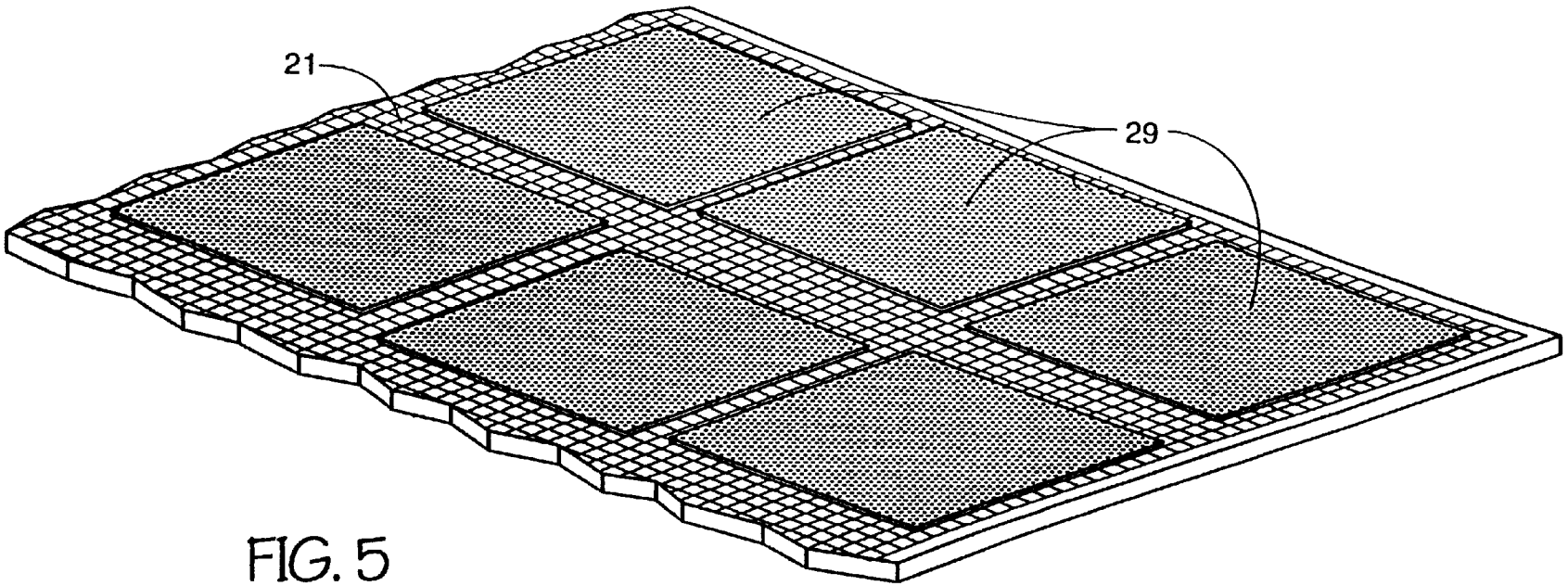
FIG. 5 is a schematic cross-section of an electrode plate of a flat panel display with the slices of FIG. 3 disposed thereon.

In the illustrative example, the slices 29 are disposed all about the display face 16 or baseplate 21, but the spacer support structures or micro-pillars 18 are formed only at the sites of the adhesive dots 26. The spacer support structures 18 which contact the adhesive dots 26 remain on the display face 16 or baseplate 21. The remaining spacer support structures 18 are removed by subsequent processing. FIG. 5 shows the manner in which the tiles 29 are placed in contact with the predetermined adhesive dots 26 on the black matrix region 25 of the faceplate 16 or in a location corresponding to the black matrix region 25 along the baseplate 21. The display face 16 or baseplate 21, with slices 29 disposed thereon, is forced against its complementary display surface to enhance adhesion and perpendicular arrangement of the spacer support structures 18 to the display face 16 or baseplate 21.

Figure 6A:
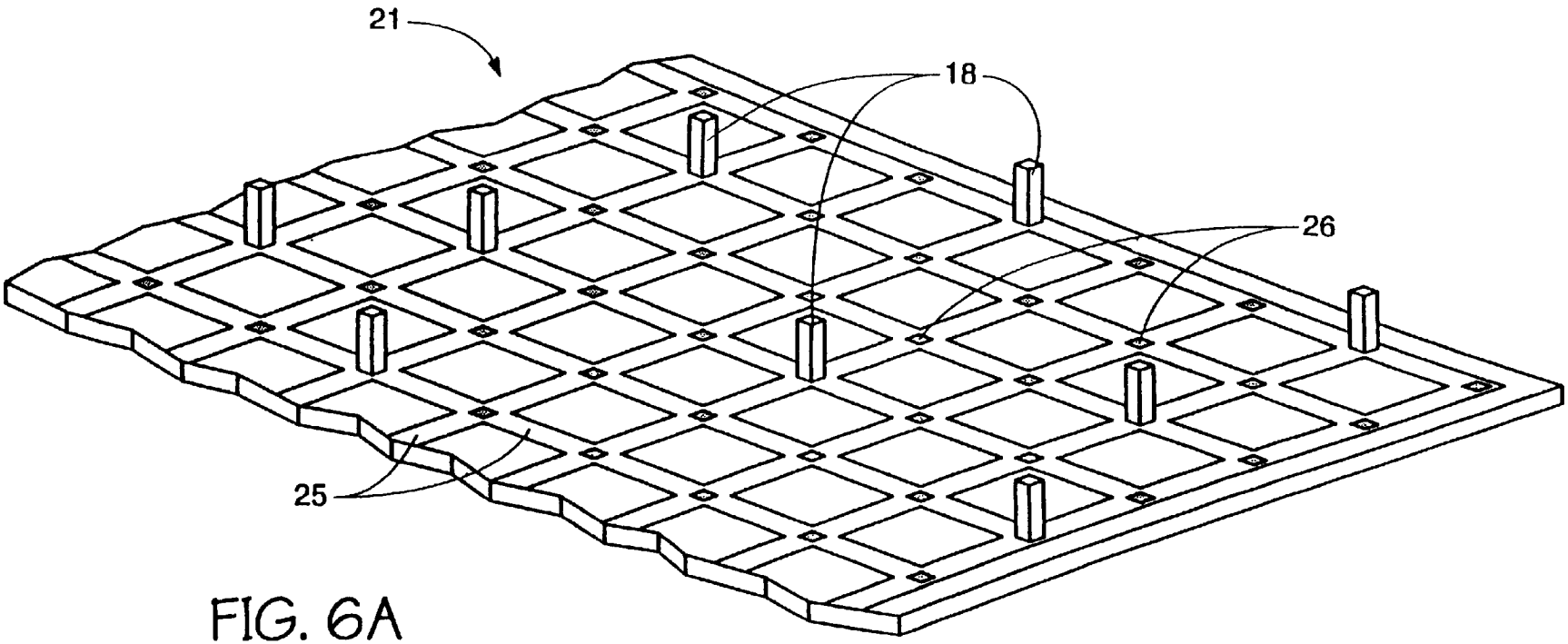
FIGS. 6A–C are schematic cross-sections of a spacer support structure, fabricated according to the process of the present invention.

The glass fibers 18A, 18B, which do not contact adhesive dots 26, are physically dislodged when the binder or etchable glass strands between the glass fibers 18A, 18B are dissolved, thereby leaving a distribution of contiguous high aspect ratio spacer support structures 18. Since the fibers 18A, 18B are chosen for selective etchability, the etchable strands or glass fibers 18B are removed by applying acid, for example, hydrochloric acid or aqueous hydrofluoric acid. This results in glass spacer support structures 18 in predetermined locations that protrude substantially perpendicular from the display face 16 or baseplate 21, as shown in FIGS. 6A–C.

Figure 6B:
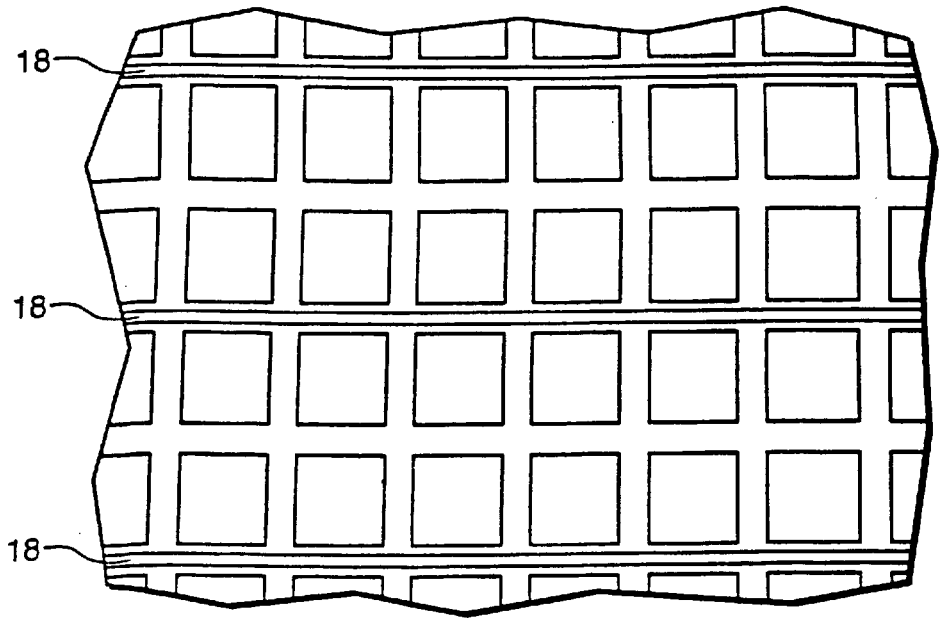
Figure 6C:
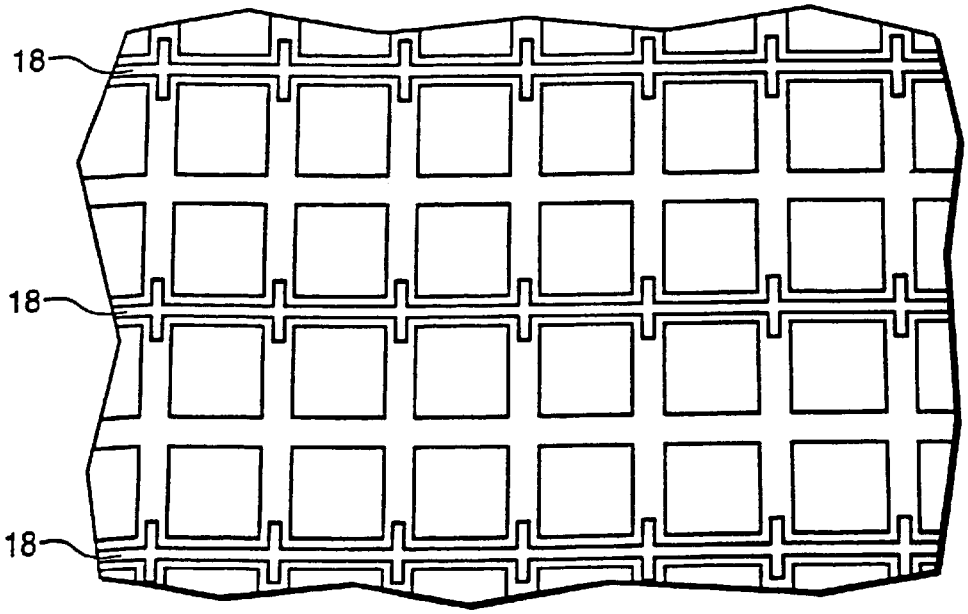

The selective placement and adhesion of contiguous glass spacer support structures 18, according to the preferred embodiment of the invention, results in a rail structure or I-beam structure, as illustrated in FIGS. 6B and 6C, respectively. The thickness of the slice, FIG. 2C, will determine whether the cross-section of the rails, etc., is rectangular or square. The rail or I-beam support structures can be either continuous or discontinuous, depending upon the pattern of the glass fibers in the boule 38.

As the spacer support structure 18 is formed from glass fibers 18A, 18B arranged contiguously, a pattern is formed by placing a nonetchable glass strand or fiber 18A proximate an etchable glass strand or fiber 18B, as shown in FIG. 2A. When the tile 29 is exposed to an etchant, the etchable glass strands or fibers 18B are removed, thereby producing a discontinuity in the line of contiguous fibers 18A, 18B. Hence, a pattern is created using contiguous fibers 18A, 18B separated by discontinuities or spaces which result from the removal of the etchable fibers 18B.

In addition to the discontinuities which may result from the selected pattern (e.g., a cross or T-shaped structure), there may be slight discontinuities as a result of the manufacturing process. In such a case, the discontinuity, or break in the line of contiguous fibers, results not from intentional patterning, but rather from a fiber dislodging occurrence in the manufacturing environment.

Since the bending moment of the spacer is dependent on the cross-sectional area, the process of the present invention allows for an increase in the lateral dimension without a corresponding increase in total surface area.

While the particular process, as herein shown and disclosed in detail, is fully capable of obtaining the objects and advantages hereinbefore stated, it is to be understood that it is merely illustrative of embodiments of the invention, and that no limitations are intended to the details of the construction or the design herein shown, other than as described in the appended claims.

One having ordinary skill in the art will realize that, even though a field emission display was used as an illustrative example, the process is equally applicable to other vacuum displays (such as gas discharge (plasma) and flat vacuum fluorescent displays), and other devices requiring physical supports in an evacuated cavity.

What is claimed is:

1. A display device comprising:

a baseplate;

a faceplate located opposite said baseplate and in parallel relation thereto; and a series of spacer support structures each having a first rectangular cross-section and disposed between and connecting said baseplate and said faceplate, said spacer support structures each having a plurality of fibers, said plurality of fibers each having a second rectangular cross-section and arranged to collectively form said first rectangular cross-section of each of said spacer support structures.

2. The display device of claim 1, wherein said spacer support structures are longitudinally disposed perpendicularly to said baseplate and said faceplate.

3. The display device of claim 1, wherein said spacer support structures are longitudinally disposed in parallel relation to said baseplate and said faceplate.

4. The display device of claim 1, wherein said spacer support structures comprise at least one of posts and rails.

5. The display device of claim 4, wherein said at least one of said posts and said rails includes cross-pieces disposed at substantially right angles thereto.

6. The display device of claim 1, further comprising pixels arranged in rows and columns, said series of spacer support structures being disposed between said pixels.

7. The display device of claim 6, wherein said series of spacer support structures is discontinuous.

8. The display device of claim 1, wherein said series of said spacer support structures is configured in an array.

9. The display device of claim 1, further comprising a black matrix disposed on said faceplate, said series of spacer support structures being disposed in said black matrix.

10. The display device of claim 1, wherein said series of spacer support structures comprises potash rubidium lead.

11. The display device of claim 1, wherein said series of spacer support structures includes a highly resistive coating.

12. A spacer support structure having a first rectangular cross-section for use in a display device, the spacer support structure comprising:

a plurality of fibers each having a second rectangular cross-section and arranged to collectively form said first rectangular cross-section of said spacer support structure.

13. The spacer support structure of claim 12, wherein said plurality of fibers collectively comprises at least one of a post and a rail.

14. The spacer support structure of claim 13, wherein said at least one of said post and rail includes at least one cross-piece disposed at substantially right angles thereto.

15. The spacer support structure of claim 13, wherein said rail-comprises contiguous fiber widths of said plurality of fibers that comprise a length of said rail.

16. The spacer support structure of claim 13, wherein said rail is discontinuous.

17. The spacer support structure of claim 12, wherein said plurality of fibers comprises glass fibers.

18. The spacer support structure of claim 12, wherein said plurality of fibers comprises potash rubidium lead.

19. A display device comprising:

a baseplate;

a faceplate located opposite said baseplate and in parallel relation thereto; and an array of spacer support structures each having a rectangular cross-section and disposed between and connecting said baseplate and said faceplate, said spacer support structures each having a plurality of fibers arranged to collectively form said rectangular cross-section of each of said spacer support structures.

20. The device of claim 19, wherein said spacer support structures are longitudinally disposed in a position substantially perpendicular to said baseplate and said faceplate.

21. The device of claim 19, wherein said spacer support structures are longitudinally disposed in a position parallel to said baseplate and said faceplate.

22. The device of claim 19, wherein said spacer support structures collectively comprise at least one of posts and rails.

23. The device of claim 22, wherein said at least one of said posts and said rails includes cross-pieces disposed at substantially right angles thereto.

24. The device of claim 19, further comprising pixels arranged in rows and columns, said array of spacer support structures being disposed between said pixels.

25. The device of claim 24, wherein said array of spacer support structures are discontinuous.

26. The device of claim 19, further comprising a black matrix disposed on said faceplate, said array of spacer support structures being disposed in said black matrix.

27. The device of claim 19, wherein said array of spacer support structures comprises potash rubidium lead.

28. The device of claim 19, wherein said array of spacer support structures includes a highly resistive coating.

* * * * *

UNITED STATES PATENT AND TRADEMARK OFFICE

CERTIFICATE OF CORRECTION

PATENT NO. : 6,447,354 B1
DATED : September 10, 2002
INVENTOR(S) : James J. Hofmann and Jason B. Elledge It is certified that error appears in the above-identified patent and that said Letters Patent is hereby corrected as shown below:

Column 1,
Line 12, delete “+gi”

Column 5,
Line 45, change “Δ” to -- " --

Column 8,
Line 2, change “rail-comprises” to -- rail comprises --

Signed and Sealed this

Twenty-fourth Day of February, 2004

JON W. DUDAS
*Acting Director of the United States Patent and Trademark Office*